US011621138B2

(12) United States Patent
Hong

(10) Patent No.: US 11,621,138 B2
(45) Date of Patent: Apr. 4, 2023

(54) HIGH-VOLTAGE FUSING APPARATUS

(71) Applicant: XIAMEN SET ELECTRONICS CO., LTD, Xiamen (CN)

(72) Inventor: Yaoxiang Hong, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 191 days.

(21) Appl. No.: 17/274,793

(22) PCT Filed: Sep. 18, 2019

(86) PCT No.: PCT/CN2019/106475
§ 371 (c)(1),
(2) Date: Mar. 10, 2021

(87) PCT Pub. No.: WO2020/147327
PCT Pub. Date: Jul. 23, 2020

(65) Prior Publication Data

US 2022/0051865 A1 Feb. 17, 2022

(30) Foreign Application Priority Data

Jan. 16, 2019 (CN) ..... 201920068663.5

(51) Int. Cl.
*H01H 85/12* (2006.01)
*H01H 85/143* (2006.01)
*H01H 85/20* (2006.01)

(52) U.S. Cl.
CPC ..... *H01H 85/12* (2013.01); *H01H 85/143* (2013.01); *H01H 85/20* (2013.01)

(58) Field of Classification Search
CPC .. H01H 85/0241; H01H 85/12; H01H 85/143; H01H 85/20
See application file for complete search history.

(56) References Cited

U.S. PATENT DOCUMENTS 6,583,977 B1 * 6/2003 Oglesbee ..... H01H 85/46 361/103
7,808,364 B2 * 10/2010 Chou ..... H01C 7/126 338/21
2002/0109574 A1 * 8/2002 Handcock ..... H01H 85/055 337/292

(Continued)

FOREIGN PATENT DOCUMENTS

CN 204720405 U 10/2015
CN 105190790 A 12/2015

(Continued)

*Primary Examiner* — Jacob R Crum
(74) *Attorney, Agent, or Firm* — Bayramoglu Law Offices LLC

(57) ABSTRACT

A high-voltage fusing apparatus includes a current fuse, a temperature fuse, and a current-carrying fuse. The current fuse is connected in series with the temperature fuse, and a series branch of the current fuse and the temperature fuse is connected in parallel with the current-carrying fuse. A resistance value of the current-carrying fuse is less than a resistance value of the current fuse, and a fusing temperature of the current-carrying fuse is lower than a fusing temperature of the temperature fuse. The high-voltage fusing apparatus can cut off a high-voltage circuit quickly, and effectively protect the high-voltage heating circuit from overheating.

10 Claims, 3 Drawing Sheets

(56) References Cited

U.S. PATENT DOCUMENTS

| | | | | |
|---|---|---|---|---|
| 2003/0134183 | A1* | 7/2003 | Iwasaki | H02H 7/18 429/62 |
| 2007/0025042 | A1* | 2/2007 | Nishikawa | H01H 85/0241 361/104 |
| 2016/0027603 | A1* | 1/2016 | Satou | H01C 7/10 338/21 |
| 2016/0086757 | A1* | 3/2016 | Xu | H01H 85/048 337/183 |
| 2016/0189905 | A1* | 6/2016 | Lanning | H01H 85/143 337/159 |
| 2017/0004947 | A1* | 1/2017 | Hong | H01H 85/46 |
| 2017/0076900 | A1* | 3/2017 | Iwai | H01H 85/0241 |
| 2018/0040443 | A1* | 2/2018 | Yokota | H01H 37/34 |

FOREIGN PATENT DOCUMENTS

| | | | |
|---|---|---|---|
| CN | 205900482 | U | 1/2017 |
| CN | 206976271 | U | 2/2018 |
| CN | 206976273 | U | 2/2018 |
| CN | 208093500 | U | 11/2018 |
| DE | 2339400 | A1 | 2/1975 |

* cited by examiner

HIGH-VOLTAGE FUSING APPARATUS

CROSS REFERENCE TO THE RELATED APPLICATIONS

This application is the national phase entry of International Application No. PCT/CN2019/106475, filed on Sep. 18, 2019, which is based upon and claims priority to Chinese Patent Application No. 201920068663.5, filed on Jan. 16, 2019, the entire contents of which are incorporated herein by reference.

TECHNICAL FIELD

The present invention relates to the technical field of high-voltage fusing, and more particularly, to a high-voltage fusing apparatus.

BACKGROUND

At present, electric vehicles mostly use a Positive Temperature Coefficient (PTC) heater to supply heat to the cabin and the passenger compartment, as well as defrosting and defogging the vehicle.

As shown in FIG. 1, a prior PTC heating circuit includes a low-voltage circuit and a high-voltage heating circuit. Specifically, the low-voltage circuit includes the temperature control switch 1 and coils of the high-voltage relay 2, which are connected in series. The high-voltage heating circuit includes contacts of the high-voltage relay 2 and the PTC heater 3. An overheating protection process of the prior PTC heating circuit is as follows. When the temperature in the low-voltage circuit reaches a preset temperature of the temperature control switch 1, a normally closed contact of the temperature control switch 1 is disconnected, the coils of the high-voltage relay 2 lose power, so that the low-voltage circuit controls the contact of the high-voltage relay 2 to be disconnected, and the PCT heater 3 stops heating. The contacts of the high-voltage relay, however, is prone to sticking. As a result, the high-voltage heating circuit cannot be cut off when the temperature is excessively high, which can damage the PTC heater and vehicle parts, and even cause the vehicle to spontaneously combust.

SUMMARY

In view of the foregoing problems, a high-voltage fusing apparatus of the present invention can quickly cut off a high-voltage circuit, and effectively protect a high-voltage heating circuit from overheating.

In order to solve the above technical problems, the present invention provides a high-voltage fusing apparatus, including a current fuse, a temperature fuse, and a current-carrying fuse.

The current fuse is connected in series with the temperature fuse, and a series branch of the current fuse and the temperature fuse is connected in parallel with the current-carrying fuse.

A resistance value of the current-carrying fuse is less than a resistance value of the current fuse, and a fusing temperature of the current-carrying fuse is lower than a fusing temperature of the temperature fuse.

Preferably, a resistance value of the temperature fuse is less than the resistance value of the current fuse.

Preferably, the high-voltage fusing apparatus further includes an insulating shell and a cover plate. The insulating shell and the cover plate form a current fusing cavity, a temperature fusing cavity and a current-carrying fusing cavity which are isolated from each other, to package the current fuse, the temperature fuse and the current-carrying fuse, respectively. The insulating shell and the cover plate are sealed by a sealing adhesive.

Preferably, the high-voltage fusing apparatus further includes a left electrode piece and a right electrode piece. The left electrode piece is connected to the current fuse and a first end of the current-carrying fuse, respectively, and the right electrode piece is connected to a second end of the temperature fuse and a second end of the current-carrying fuse, respectively. The left electrode piece and the right electrode piece extend out of the insulating shell as lead ends.

Preferably, a top wall of the current-carrying fusing cavity is provided with a first U-shaped boss, and an upper surface of the cover plate is provided with a second U-shaped boss. The first U-shaped boss and the second U-shaped boss are arranged directly opposite to each other, and joint surfaces of the first U-shaped boss and the second U-shaped boss are staggered.

Preferably, a first L-shaped connecting portion is arranged at a first end of the left electrode piece, and a second L-shaped connecting portion is arranged at a first end of the right electrode piece.

The current-carrying fuse includes at least one fusible alloy connecting segment. One end of the at least one fusible alloy connecting segment is connected to the first L-shaped connecting portion, and the other end of the at least one fusible alloy connecting segment is connected to the second L-shaped connecting portion.

An outer wall of the at least one fusible alloy connecting segment is provided with a fluxing agent.

Preferably, a first terminal is arranged at the first end of the left electrode piece, and a second terminal is arranged at the first end of the right electrode piece.

The current fuse includes a first n-shaped fuse body, and the temperature fuse includes a second n-shaped fuse body.

A first end of the first n-shaped fuse body is connected to the first terminal, and a second end of the first n-shaped fuse body is connected to a first end of the second n-shaped fuse body through a bridging piece.

A second end of the second n-shaped fuse body is connected to the second terminal.

Preferably, a first breaking insulation block is arranged between parallel segments of the first n-shaped fuse body, and a second breaking insulation block is arranged between parallel segments of the second n-shaped fuse body.

Preferably, the high-voltage fusing apparatus further includes a heater arranged tightly adjacent to the current-carrying fuse and the temperature fuse.

The heater is connected to a controller through a circuit switch.

The controller is configured to control the circuit switch to close according to temperature anomaly information to enable the heater to generate heat. The temperature anomaly information is read by the controller.

Preferably, the high-voltage fusing apparatus further includes a thermal fuse connected in series with the heater, and a fusing temperature of the thermal fuse is higher than the fusing temperature of the temperature fuse.

Preferably, the high-voltage fusing apparatus further includes a plurality of first connecting wires and a plurality of second connecting wires, and an insulating layer is sleeved on outer walls of the first connecting wires and the second connecting wires. First ends of the plurality of first connecting wires are soldered to the first end of the left electrode piece, and second ends of the plurality of first connecting wires are led out axially or radially. The first ends of the plurality of first connecting wires and solder joints of the plurality of first connecting wires are covered in the sealing adhesive. First ends of the plurality of second connecting wires are soldered to the first end of the right electrode piece, and second ends of the plurality of second connecting wires are led out axially or radially. The first ends of the plurality of second connecting wires and solder joints of the plurality of second connecting wires are covered in the sealing adhesive.

In the high-voltage fusing apparatus of the present invention, the current fuse and the temperature fuse are connected in series to form the high-voltage fuse. The resistance value of the current-carrying fuse is less than the resistance value of the current fuse. Therefore, under a normal condition, the current mainly flows through the current-carrying fuse to enable the current-carrying fuse to generate heat. Under an abnormal condition, the current flowing through the current-carrying fuse increases, causing the current-carrying fuse to generate more heat and the temperature to rise. When the temperature of the current-carrying fuse exceeds its fusing temperature, the current-carrying fuse fuses, so that the parallel branch where the current-carrying fuse is located is disconnected, and the current is switched to the branch where the high-voltage fuse is located. In this case, if the current is greater than the overcurrent of the current fuse, the current fuse performs high-voltage fusing, so that the high-voltage fusing apparatus completes a circuit cut-off function. If the current is less than the overcurrent of the current fuse, the temperature of the high-voltage fuse continues to rise until it exceeds the fusing temperature of the temperature fuse. At this time, the temperature fuse performs high-voltage fusing, so that the high-voltage fusing apparatus completes the circuit cut-off function.

Compared with the prior art, the high-voltage fusing apparatus of the present invention has the following advantages. Since the current-carrying fuse is connected in parallel with the high-voltage fuse, the high-voltage fusing apparatus does not generate an arc when the current-carrying fuse fuses. When the current is switched to the high-voltage fuse, the current fuse or the temperature fuse can quickly perform high-voltage cut-off, which effectively protects the high-voltage heating circuit from overheating.

The above description is merely a summary of the technical solution of the present invention. In order to make the technical means of the present invention understood more clearly and implemented in accordance with the content of the specification, and in order to make one of the above and other objectives, features and advantages of the present invention more obvious and easier to understand, embodiments of the present invention are described below.

BRIEF DESCRIPTION OF THE DRAWINGS

To describe the technical solutions in the embodiments of the present invention or in the prior art more clearly, the drawings required for describing the embodiments or the prior art are briefly described below. Obviously, the drawings in the following description show some embodiments of the present invention, and those having ordinary skill in the art may still derive other drawings from these drawings without creative efforts.

In the figures.

Figure 1:
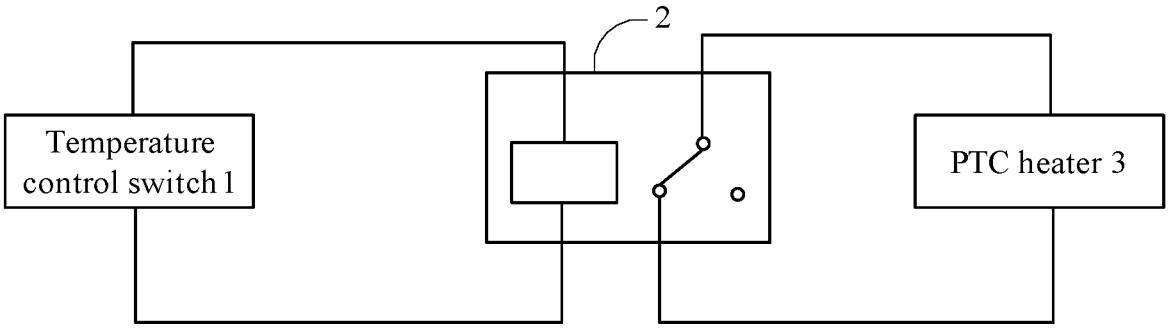
FIG. 1 (Prior art)
FIG. 1 is a schematic diagram of the structure of a PTC heating circuit in the prior art.

1: temperature control switch
2: high-voltage relay
3: PTC heater
101: current-carrying fuse
102: current fuse
103: temperature fuse
104: heater
105: thermal fuse
110: high-voltage fuse
201: insulating shell
201*a*: first U-shaped boss
202: cover plate
202*a*: second U-shaped boss
202*b*: first breaking insulation block
202*c*: second breaking insulation block
203: left electrode piece
203*a*: first L-shaped connecting portion
203*b*: first terminal
204: right electrode piece
204*a*: second L-shaped connecting portion
204*b*: second terminal
205: fusible alloy connecting segment
206: first fluxing agent
207: first n-shaped fuse body
208: arc extinguishing grease
209: bridging piece
210: second n-shaped fuse body
211: epoxy resin
212: second fluxing agent
213: current-carrying fusing cavity
214: current fusing cavity
215: temperature fusing cavity

DETAILED DESCRIPTION OF THE EMBODIMENTS

In order to make the objectives, technical solutions and advantages of the embodiments of the present invention clearer, the technical solutions in the embodiments of the present invention will be clearly and completely described below with reference to the drawings in the embodiments of the present invention. Obviously, the described embodiments are some of the embodiments of the present invention, rather than the entire embodiments. All other embodiments obtained by those having ordinary skill in the art based on the embodiments of the present invention without creative efforts shall fall within the scope of protection of the present invention.

The following describes many details in order to provide a thorough understanding of the present invention. However, the present invention can be implemented in many ways other than those described herein, and those skilled in the art can make similar expansions without departing from the inventive concept of the present invention. Therefore, the present invention is not limited to the specific embodiments disclosed below.

The technical solutions of the present invention are clearly and completely described below with reference to the specific embodiments and the drawings.

Embodiment 1

Figure 2:
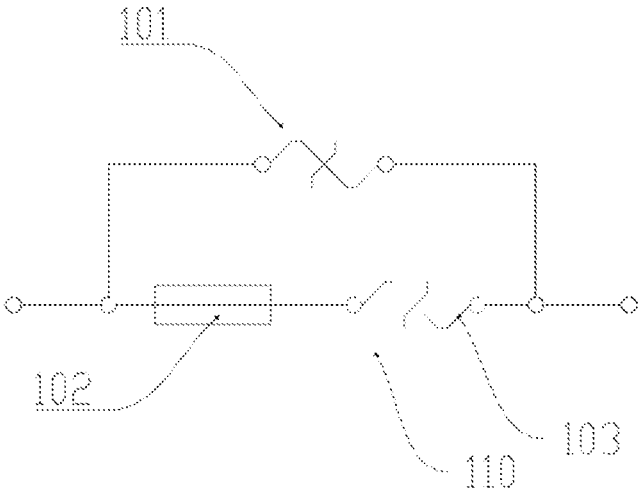
FIG. 2 is a schematic diagram of the structure of a high-voltage fusing apparatus according to Embodiment 1 of the present invention.

FIG. 2 is a schematic diagram of the structure of a high-voltage fusing apparatus according to Embodiment 1 of the present invention.

As shown in FIG. 2, the high-voltage fusing apparatus includes the current fuse 102, the temperature fuse 103, and a current-carrying fuse 101. The current fuse 102 is connected in series with the temperature fuse 103, and a series branch of the current fuse 102 and the temperature fuse 103 is connected in parallel with the current-carrying fuse 101. The resistance value of the current-carrying fuse 101 is less than the resistance value of the current fuse 102, and the fusing temperature of the current-carrying fuse 101 is lower than the fusing temperature of the temperature fuse 103.

In the high-voltage fusing apparatus of the present invention, the current fuse 102 and the temperature fuse 103 are connected in series to form the high-voltage fuse 110. The resistance value of the current-carrying fuse 101 is less than the resistance value of the current fuse 102. Therefore, under a normal condition, the current mainly flows through the current-carrying fuse 101 to enable the current-carrying fuse 101 to generate heat. Under an abnormal condition, the current flowing through the current-carrying fuse 101 increases, causing the current-carrying fuse 101 to generate more heat and the temperature to rise. When the temperature of the current-carrying fuse 101 exceeds its fusing temperature, the current-carrying fuse 101 fuses, so that the parallel branch where the current-carrying fuse 101 is located is disconnected, and the current is switched to the branch where the high-voltage fuse 110 is located. In this case, if the current is greater than the overcurrent of the current fuse 102, the current fuse 102 performs high-voltage fusing, so that the high-voltage fusing apparatus completes a circuit cut-off function. If the current is less than the overcurrent of the current fuse 102, the temperature of the high-voltage fuse 110 continues to rise until it exceeds the fusing temperature of the temperature fuse 103. At this time, the temperature fuse 103 performs high-voltage fusing, so that the high-voltage fusing apparatus completes the circuit cut-off function.

Compared with the prior art, the high-voltage fusing apparatus of the present invention has the following advantages. Since the current-carrying fuse is connected in parallel with the high-voltage fuse, the high-voltage fusing apparatus does not generate an arc when the current-carrying fuse fuses. When the current is switched to the high-voltage fuse, the current fuse or the temperature fuse can quickly perform high-voltage cut-off, which effectively protects the high-voltage heating circuit from overheating.

Preferably, as shown in FIG. 2, in the high-voltage fusing apparatus, the resistance value of the temperature fuse 103 is less than the resistance value of the current fuse 102, so that when the current of an identical value passes through the high-voltage fuse 110, heat generated by the current fuse 102 is larger than heat generated by the temperature fuse 103. Therefore, when the current switched to the high-voltage fuse 110 is smaller than the overcurrent of the current fuse 102, the heat generated by the current fuse 102 can be used to cause the temperature fuse 103 to fuse.

Embodiment 2

Figure 3:
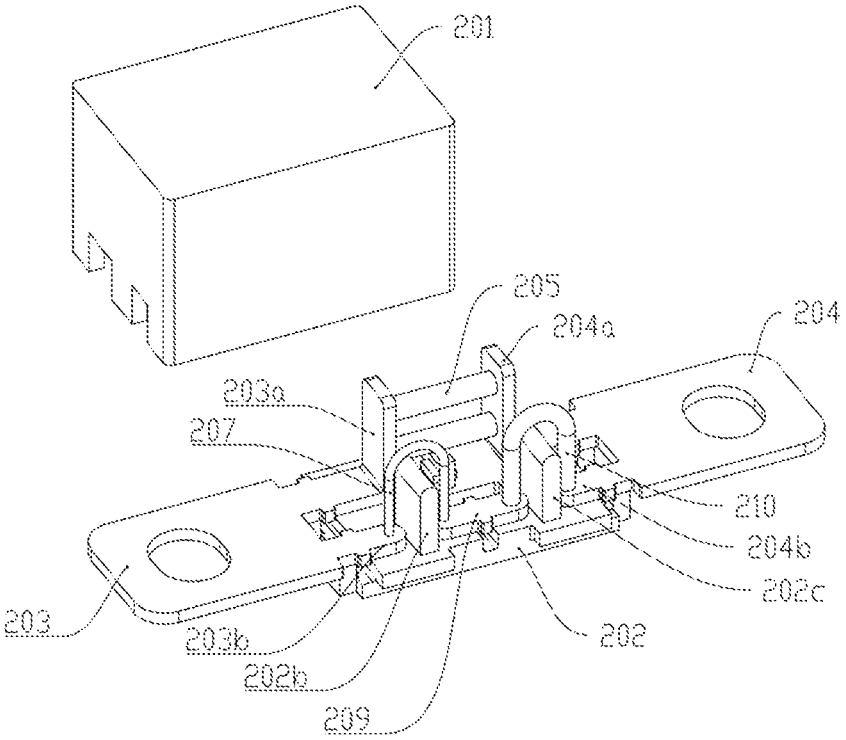
FIG. 3 is an exploded view of a high-voltage fusing apparatus according to Embodiment 2 of the present invention.

FIG. 3 is an exploded view of a high-voltage fusing apparatus according to Embodiment 2 of the present invention.

Figure 4:
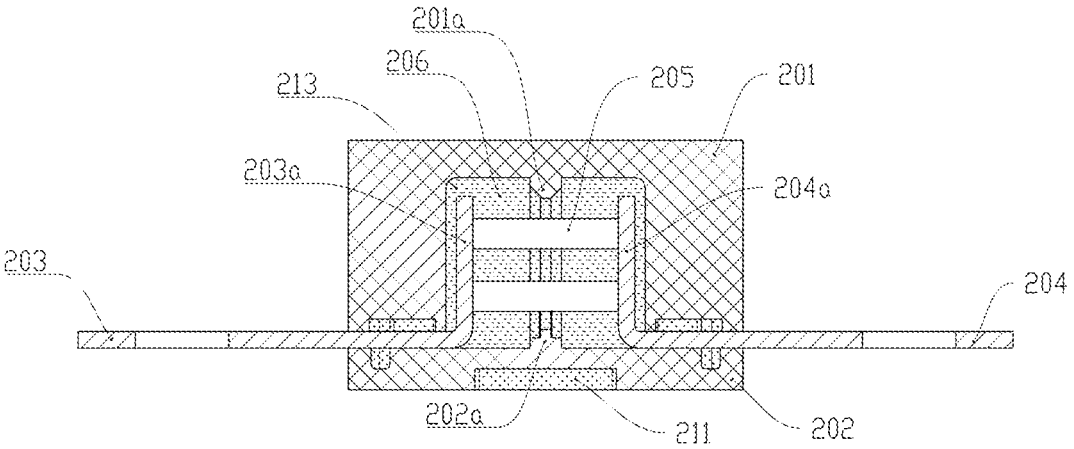
FIG. 4 is a transverse cross-sectional view of a current-carrying fusing cavity according to Embodiment 2 of the present invention.
Figure 5:
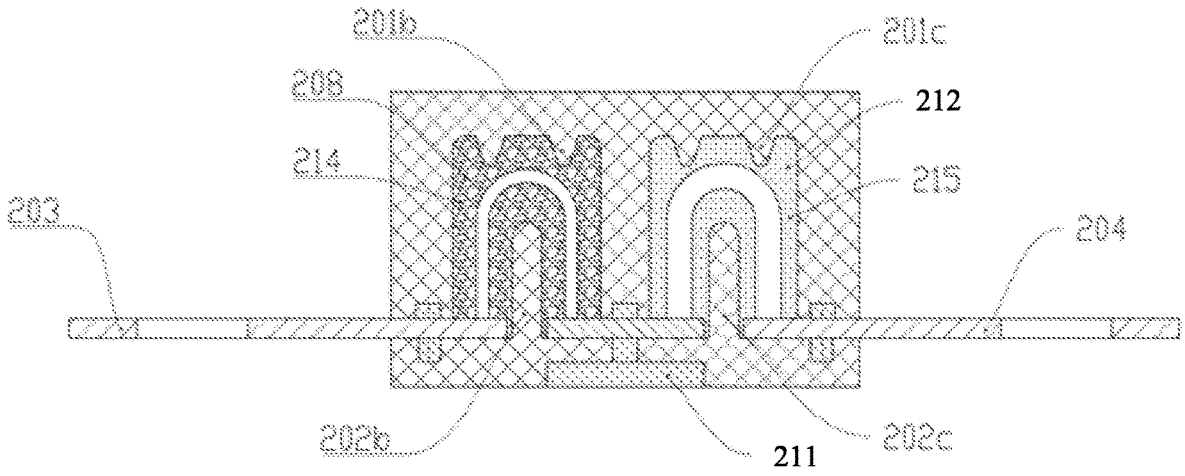
FIG. 5 is a transverse cross-sectional view of a current fusing cavity and a temperature fusing cavity according to Embodiment 2 of the present invention.

As shown in FIGS. 3-5, the high-voltage fusing apparatus further includes the insulating shell 201 and the cover plate 202. The insulating shell 201, the cover plate 202 and the epoxy resin 211 form the current fusing cavity 214, the temperature fusing cavity 215, and the current-carrying fusing cavity 213, which are isolated from each other, to package the current fuse, the temperature fuse and the current-carrying fuse, respectively. The insulating shell 201 and the cover plate 202 are sealed by a sealing adhesive.

Preferably, as shown in FIG. 3, the high-voltage fusing apparatus further includes the left electrode piece 203 and the right electrode piece 204. The left electrode piece 203 is connected to the current fuse and a first end of the current-carrying fuse, respectively, and the right electrode piece 204 is connected to a second end of the temperature fuse and a second end of the current-carrying fuse, respectively. The left electrode piece 203 and the right electrode piece 204 are arranged in a mirror-image relation, face-to-face, and at an interval, and extend out of the insulating shell 201 as lead ends.

As shown in FIGS. 3 and 4, in the current-carrying fusing cavity 213, the first L-shaped connecting portion **203*a* is arranged at a first end of the left electrode piece 203, and the second L-shaped connecting portion 204*a* is arranged at a first end of the right electrode piece 204. The current-carrying fuse includes at least one fusible alloy connecting segment 205. One end of the at least one fusible alloy connecting segment 205 is connected to the first L-shaped connecting portion 203*a*, and the other end of the at least one fusible alloy connecting segment 205 is connected to the second L-shaped connecting portion 204*a*. The outer wall of the at least one fusible alloy connecting segment 205 is provided with the first fluxing agent 206**.

Preferably, the fusible alloy connecting segment 205 may be arranged in different diameters, lengths or amounts according to the flow capacity and breaking capacity, with a ratio of diameter to length greater than 1:3. The fusible alloy connecting segment 205 includes metals with a melting point lower than 300° C., and alloys thereof, such as alloys composed of Bi, Sn, In and other low-melting-point metal elements.

Preferably, as shown in FIG. 4, the first fluxing agent 206 of the current-carrying fuse is filled in the current-carrying fusing cavity 213 to cover the outer surface of the at least one fusible alloy connecting segment 205. When the temperature of the at least one fusible alloy connecting segment 205 reaches its melting temperature, the fusible alloy connecting segment 205 contracts and breaks under the action of the tension of the first fluxing agent 206, thereby disconnecting the parallel branch where the current-carrying fuse is located.

Preferably, as shown in FIG. 4, the top wall of the current-carrying fusing cavity 213 is provided with the first U-shaped boss **201*a*, and the upper surface of the cover plate 202 is provided with the second U-shaped boss 202*a*. The first U-shaped boss 201*a* and the second U-shaped boss 202*a* are arranged directly opposite to each other, and joint surfaces of the first U-shaped boss 201*a* and the second U-shaped boss 202*a* are staggered to form isolation bosses of the current-carrying fusing cavity 213 to increase a creepage distance between the left electrode piece 203 and the right electrode piece 204, thereby improving the safety performance of the high-voltage fusing apparatus after the fusible alloy connecting segment 205** fuses.

Preferably, as shown in FIGS. 3 and 5, the first terminal 203*b*, a first end of the bridging piece 209, and the current fuse are packaged in the current fusing cavity 214. The first terminal 203*b* is arranged at the first end of the left electrode piece 203. The current fuse includes the first n-shaped fuse body 207, and the first n-shaped fuse body 207 is connected between the first terminal 203*b* and the first end of the bridging piece 209. The current fusing cavity 214 is filled with the arc extinguishing grease 208.

Preferably, as shown in FIGS. 3 and 5, the first breaking insulation block 202*b* is arranged between parallel segments of the first n-shaped fuse body 207 to increase an electrical gap and a creepage distance between the left electrode piece 203 and the bridging piece 209 after the first n-shaped fuse body 207 is disconnected.

Preferably, as shown in FIGS. 3 and 5, the second terminal 204*b*, a second end of the bridging piece 209, and the temperature fuse are packaged in the temperature fusing cavity 215. The second terminal 204*b* is arranged at the first end of the right electrode piece 204. The temperature fuse includes the second n-shaped fuse body 210, and the second n-shaped fuse body 210 is connected between the second terminal 204*b* and the second end of the bridging piece 209. The temperature fusing cavity 215 is filled with the second fluxing agent 212.

Preferably, as shown in FIGS. 3 and 5, the second breaking insulation block 202*c* is arranged between parallel segments of the second n-shaped fuse body 210 to increase an electrical gap and a creepage distance between the right electrode piece 204 and the bridging piece 209 after the second n-shaped fuse body 210 is disconnected.

In a specific implementation process, the high-voltage fusing apparatus in Embodiment 2 is connected in series in a high-voltage heating circuit in a PTC heating circuit of an electric vehicle, and a working process is as follows.

As shown in FIGS. 3-5, under a normal condition, the current-carrying fuse undertakes the main current-carrying function. When a high-voltage relay in the high-voltage heating circuit fails, the PTC heater continues to work and the temperature rises abnormally. When the temperature exceeds the softening temperature of the first fluxing agent 206 in the current-carrying fusing cavity 213, the first fluxing agent 206 changes from a solid state to a liquid state to activate a surface oxide layer of the fusible alloy connecting segment 205. When the temperature exceeds the fusing temperature of the fusible alloy connecting segment 205, the fusible alloy connecting segment 205 contracts and moves toward the first L-shaped connecting portion 203*a* and the second L-shaped connecting portion 204*a* under the action of the tension of the first fluxing agent 206, and then the fusible alloy connecting segment fuses.

When the current is switched to the high-voltage fuse and exceeds the current-carrying capacity of the first n-shaped fuse body 207, due to the high resistance of the first n-shaped fuse body 207, heat generated by the first n-shaped fuse body 207 increases until the temperature exceeds its fusing temperature, and then the first n-shaped fuse body 207 fuses. In the fusing and breaking process of the first n-shaped fuse body 207, since the first n-shaped fuse body 207 fuses and has parallel segments, a high-intensity electric field forms between the fused parallel segments, and the arc can be elongated by using the mutual repulsion between electrons to accelerate recombination and diffusion of free electrons and positive ions, thereby effectively enhancing the arc extinguishing capability. Moreover, since the current fusing cavity 214 is filled with the arc extinguishing grease 208, and the arc extinguishing grease 208 can absorb the arc shock, and cut off the arc under the division of the first breaking insulation block 202*b*, the arc can be cut off quickly to ensure the safety of the high-voltage heating circuit.

When the current is switched to the high-voltage fuse and is less than the current-carrying capacity of the first n-shaped fuse body 207, the PTC heater continues to work, and the temperature gradually rises to the fusing temperature of the second n-shaped fuse body 210. The second n-shaped fuse body 210 contracts and moves toward the second end of the bridging piece 209 and the second terminal 204*b* under the action of the tension of the second fluxing agent 212, and then the second n-shaped fuse body 210 fuses. In the fusing and breaking process of the second n-shaped fuse body 210, since the second n-shaped fuse body 210 fuses and has parallel segments, a high-intensity electric field forms between the fused parallel segments, and the arc can be elongated by using the mutual repulsion between electrons to accelerate recombination and diffusion of free electrons and positive ions, thereby effectively enhancing the arc extinguishing capability. Moreover, the arc is cut off under the division of the second breaking insulation block 202*c*, so that the arc can be cut off quickly to ensure the safety of the entire vehicle.

Embodiment 3

Figure 6:
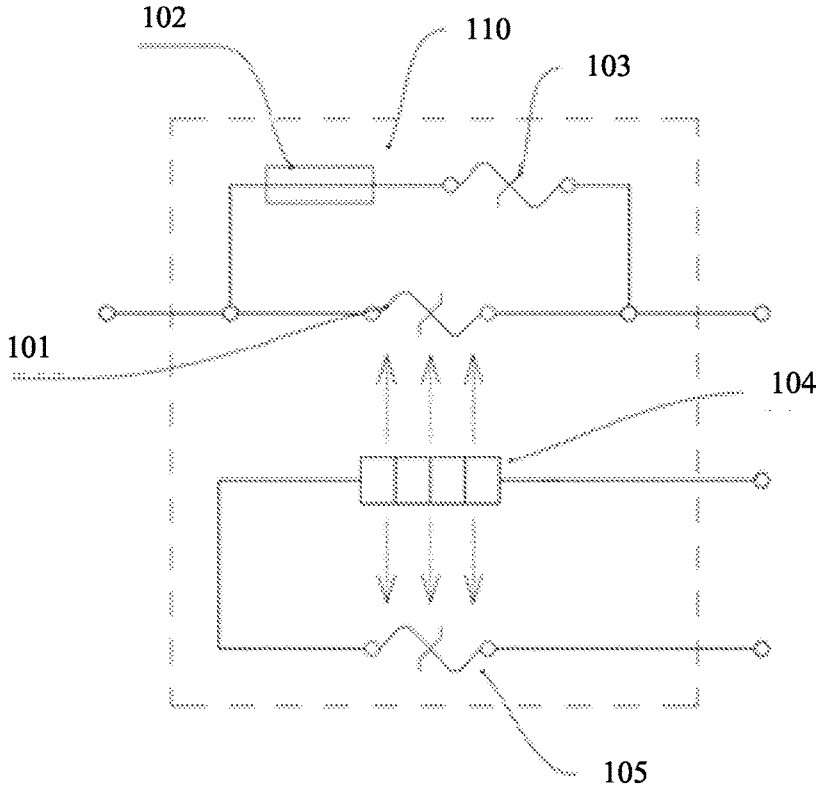
FIG. 6 is a schematic diagram of the structure of a high-voltage fusing apparatus according to Embodiment 3 of the present invention.

FIG. 6 is a schematic diagram of the structure of a high-voltage fusing apparatus according to Embodiment 3 of the present invention.

As shown in FIG. 6, in addition to all the components in Embodiment 1 or Embodiment 2, the high-voltage fusing apparatus further includes the heater 104, which is arranged tightly adjacent to the current-carrying fuse 101 and the temperature fuse 103. The heater 104 is connected to a controller through a circuit switch (not shown). The controller is configured to control the circuit switch to close according to temperature anomaly information to enable the heater 104 to generate heat. The temperature anomaly information is read by the controller.

In this embodiment, the controller is configured to control the circuit switch to close according to the temperature anomaly information to enable the heater 104 to generate heat, so that the heater 104 supplies heat to the current-carrying fuse 101 and the temperature fuse 103 to accelerate the fusing of the current-carrying fuse 101 or the temperature fuse 103.

Preferably, as shown in FIG. 6, the high-voltage fusing apparatus further includes the thermal fuse 105 connected in series with the heater 104. The fusing temperature of the thermal fuse 105 is higher than the fusing temperature of the temperature fuse 103. The thermal fuse 105 is configured to protect the heater 104 from overheating, that is, when the temperature of the heater 104 exceeds the melting point of the thermal fuse 105, the thermal fuse 105 is disconnected to cut off the working circuit of the heater 104, so that the heater 104 stops heating.

Preferably, in the foregoing embodiments, the high-voltage fusing apparatus further includes a plurality of first connecting wires and a plurality of second connecting wires (not shown). An insulating layer is sleeved on the outer walls of the first connecting wires and the second connecting wires. First ends of the plurality of first connecting wires are soldered to the first end of the left electrode piece 203, and second ends of the plurality of first connecting wires are led out axially or radially to provide connecting lead ends. The first ends of the plurality of first connecting wires and solder joints of the plurality of first connecting wires are covered in the sealing adhesive to achieve sealing. First ends of the plurality of second connecting wires are soldered to the first end of the right electrode piece 204, and second ends of the plurality of second connecting wires are led out axially or radially to provide connecting lead ends. The first ends of the plurality of second connecting wires and solder joints of the plurality of second connecting wires are covered in the sealing adhesive to achieve sealing.

The above only describes preferred embodiments of the present invention, and is not intended to limit the present invention in any form. Therefore, any simple amendment or equivalent change and modification of the above embodiments made according to the technical essence of the present invention without departing from the content of the technical solution of the present invention shall fall within the scope of protection of the technical solution of the present invention.

The apparatus embodiment described above is merely schematic, where units described as separate components may be or not be physically separated. Components displayed as units may be or not be physical units, that is, the components may be located in one place, or may be distributed to multiple network units. Some or all of the modules may be selected according to actual needs to achieve one of the objectives of the solution of an embodiment. Those having ordinary skill in the art can understand and implement the embodiment without creative efforts.

The word "an/one embodiment", "embodiment" or "one or more embodiments" mentioned in the specification means that a specific feature, structure, or property described in combination with the embodiment is included at least one embodiment of the present invention. In addition, it should be noted that the phrase example "in an/one embodiment" herein does not necessarily refer to an identical embodiment.

In the specification provided herein, a large number of specific details are described. However, it should be understood that the embodiments of the present invention can be practiced without the specific details. In some embodiments, well-known methods, structures and techniques are not shown in detail to avoid obscuring the understanding of this specification.

In the claims, any reference sign between brackets should not be constructed as a limitation on the claims. The word "include/comprise" does not exclude the presence of elements or steps not listed in the claims. The word "one" or "a/an" preceding an element does not exclude the presence of multiple such elements. The present invention can be implemented with the assistance of hardware including several different components and the assistance of a properly programmed computer. In the unit claims where several apparatuses are listed, several of the apparatuses may be embodied by an identical hardware item. The use of words such as first, second, and third do not indicate any order. These words may be interpreted as names.

Finally, it should be noted that the foregoing embodiments are merely used to explain the technical solutions of the present invention, and are not intended to limit the same. Although the present invention is described in detail with reference to the foregoing embodiments, those having ordinary skill in the art should understand that they can still modify the technical solutions described in the foregoing embodiments, or make equivalent substitutions on some technical features therein, while these modifications or substitutions do not make the essence of the corresponding technical solutions deviate from the spirit and scope of the technical solutions of the embodiments of the present invention.

What is claimed is:

1. A high-voltage fusing apparatus, comprising a current fuse, a temperature fuse, and a current-carrying fuse; wherein the current fuse is connected in series with the temperature fuse;

a series branch of the current fuse and the temperature fuse is connected in parallel with the current-carrying fuse;

a resistance value of the current fuse is greater than a resistance value of the temperature fuse; and a resistance value of the current-carrying fuse is less than the resistance value of the current fuse; and a fusing temperature of the current-carrying fuse is lower than a fusing temperature of the temperature fuse.

2. The high-voltage fusing apparatus according to claim 1, further comprising an insulating shell and a cover plate, wherein the insulating shell and the cover plate form a current fusing cavity, a temperature fusing cavity and a current-carrying fusing cavity to package the current fuse, the temperature fuse and the current-carrying fuse, respectively, wherein the current fusing cavity, the temperature fusing cavity and the current-carrying fusing cavity are isolated from each other; and the insulating shell and the cover plate are sealed by a sealing adhesive.

3. The high-voltage fusing apparatus according to claim 2, further comprising a left electrode piece and a right electrode piece, wherein the left electrode piece is connected to the current fuse and a first end of the current-carrying fuse, respectively, the right electrode piece is connected to an end of the temperature fuse and a second end of the current-carrying fuse, respectively; and the left electrode piece and the right electrode piece extend out of the insulating shell as lead ends.

4. The high-voltage fusing apparatus according to claim 3, wherein a top wall of the current-carrying fusing cavity is provided with a first U-shaped boss, an upper surface of the cover plate is provided with a second U-shaped boss, the first U-shaped boss and the second U-shaped boss are arranged directly opposite to each other, and joint surfaces of the first U-shaped boss and the second U-shaped boss are staggered.

5. The high-voltage fusing apparatus according to claim 3, wherein a first L-shaped connecting portion is arranged at an end of the left electrode piece, and a second L-shaped connecting portion is arranged at an end of the right electrode piece;

the current-carrying fuse comprises at least one fusible alloy connecting segment;

a first end of the at least one fusible alloy connecting segment is connected to the first L-shaped connecting portion, and a second end of the at least one fusible alloy connecting segment is connected to the second L-shaped connecting portion; and an outer wall of the at least one fusible alloy connecting segment is provided with a fluxing agent.

6. The high-voltage fusing apparatus according to claim 3, wherein a first terminal is arranged at an end of the left electrode piece, and a second terminal is arranged at an end of the right electrode piece;

the current fuse comprises a first n-shaped fuse body, and the temperature fuse comprises a second n-shaped fuse body;

a first end of the first n-shaped fuse body is connected to the first terminal, and a second end of the first n-shaped fuse body is connected to a first end of the second n-shaped fuse body through a bridging piece; and a second end of the second n-shaped fuse body is connected to the second terminal.

7. The high-voltage fusing apparatus according to claim 6, wherein a first breaking insulation block is arranged between parallel segments of the first n-shaped fuse body, and a second breaking insulation block is arranged between parallel segments of the second n-shaped fuse body.

8. The high-voltage fusing apparatus according to claim 1, further comprising a heater arranged tightly adjacent to the current-carrying fuse and the temperature fuse; wherein the heater is connected to a controller;

the controller is configured to enable the heater to generate a heat according to temperature anomaly information; and the temperature anomaly information is read by the controller.

9. The high-voltage fusing apparatus according to claim 8, further comprising a thermal fuse connected in series with the heater, wherein a fusing temperature of the thermal fuse is higher than the fusing temperature of the temperature fuse.

10. The high-voltage fusing apparatus according to claim 3, further comprising a plurality of first connecting wires and a plurality of second connecting wires, wherein an insulating layer is sleeved on outer walls of the plurality of first connecting wires and outer walls of the plurality of second connecting wires;

first ends of the plurality of first connecting wires are soldered to an end of the left electrode piece, and second ends of the plurality of first connecting wires are led out axially or radially;

the first ends of the plurality of first connecting wires and solder joints of the plurality of first connecting wires are covered in the sealing adhesive;

first ends of the plurality of second connecting wires are soldered to an end of the right electrode piece, and second ends of the plurality of second connecting wires are led out axially or radially; and the first ends of the plurality of second connecting wires and solder joints of the plurality of second connecting wires are covered in the sealing adhesive.

* * * * *